United States Patent [19]

Dunk et al.

[11] Patent Number: 4,959,264

[45] Date of Patent: Sep. 25, 1990

[54] RELEASE PAPER FOR MAKING ARTIFICIAL LEATHER

[75] Inventors: Paul Dunk, Slough, Berkshire; Roger M. Hindin; Peter J. Miles, both of Buckinghamshire, all of England

[73] Assignee: The Wiggins Teape Group Limited, Basingstoke, England

[21] Appl. No.: 141,078

[22] Filed: Jan. 5, 1988

[30] Foreign Application Priority Data

Jan. 6, 1987 [GB] United Kingdom ..... 8700106

[51] Int. Cl.[5] ..... B32B 5/16; B41M 3/12

[52] U.S. Cl. ..... 428/331; 428/325; 428/352; 428/406; 428/512; 428/537.5; 428/904; 427/412

[58] Field of Search ..... 428/331, 325, 352, 406, 428/537.5, 512, 904

[56] References Cited

U.S. PATENT DOCUMENTS

| | | | |
|---|---|---|---|
| 3,826,677 | 7/1974 | Michels et al. | 428/339 |
| 4,539,056 | 9/1985 | Takeshita et al. | 428/904 |
| 4,780,507 | 10/1988 | Gaku et al. | 428/461 |

FOREIGN PATENT DOCUMENTS

| | | | |
|---|---|---|---|
| 2451809 | 5/1976 | Fed. Rep. of Germany . | |
| 46-11443 | 3/1971 | Japan | 428/537.5 |
| 48-14525 | 2/1973 | Japan . | |
| 57-119940 | of 1982 | Japan . | |
| 58-007320A | of 1983 | Japan . | |
| 59-11283 | of 1984 | Japan . | |
| 59-174609 | of 1984 | Japan . | |
| 60-020956 | of 1985 | Japan . | |

OTHER PUBLICATIONS

"*Encyclopaedia of Polymer Science and Technology,*" vol. 9, Interscience, 1968, p. 457.

*Modern plastics Encyclopedia,* 1972–1973, "Polymethylpentene", p. 88.

"TPX Laminated Paper—Processing Technology and Uses", *Proceedings, 1985 Polymers, Laminations & Coatings.*

Concise Chemical & Technical Dictionary, Ed. H. Bennett, 1947, p. 760.

*Primary Examiner*—P. C. Sluby

*Attorney, Agent, or Firm*—Burns, Doane, Swecker & Mathis

[57] ABSTRACT

A release paper for the manufacture of artificial leather, characterized by the release coating of the paper being essentially of a flexible poly(4-methyl pentene-1) resin (TPX) loaded with particulate mineral filler.

9 Claims, No Drawings

RELEASE PAPER FOR MAKING ARTIFICIAL LEATHER

The invention relates to release paper of the kind sometimes known as film casting paper, used in the manufacture of artificial leather.

The use of such release paper is an established procedure. It has a release surface, smooth or carrying a negative or reverse of a pattern (emboss) required in the final artificial leather, and is generally used by extruding onto the release surface a polyurethane or polyvinylchloride plastisol which cures to form the artificial leather. The artificial leather, carrying the positive of the emboss where present, can then be stripped from the surface. The release paper has to meet very severe requirements of heat resistance, clean stripping and (for reasonable economy) repeated use, while faithfully retaining any emboss. One of the materials preferred for use in forming the release surface is polymethylpentene poly(4-methylpentene-1), known as TPX . This shows especially good heat resistance, important particularly in the high temperature cure needed with polyvinylchloride, and has been in use since the mid-1970's, but it is very expensive.

We have sought a release paper making more economic use of TPX and have surprisingly, and contrary to our initial expectations, found that it can be extended with mineral fillers at low cost, not only retaining the required properties but in (referred to later herein) showing optimised release characteristics.

Specifically, we provide a release paper for the manufacture of artificial leather, characterised by the release coating of the paper being essentially of poly(4-methyl pentene-1) resin loaded with calcium carbonate, kaolin, silica, barytes, talc or other particulate mineral filler.

The invention further extends to the manufacture of artificial leather wherein such release paper is coated with an artificial leather forming polymer composition which is cured and stripped from the release paper to give the artificial leather.

Such manufacture may be regarded as use of a method of preventing premature release of artificial leather forming polymer compositions from release paper carrying a TPX coating and consequent loss of fidelity in reproducing the surface characteristics of the paper.

For satisfactory compounding the fillers should be particulate rather than fibrous or lamellar materials, but particle sizes are not of great importance. The limits are practical ones related to the thickness of the release layer when obviously there is an upper limit, and to ease of compounding with the resin, very fine particles being difficult to 'wet' with the resin. The quantity of filler is not critical, depending at the lower end of the range on using enough to secure significant advantage to be worthwhile and at the upper end on being able to compound the filler and polymer into a mix that can be extruded and bonded onto a release paper substrate. Also the release paper in use needs to be reeled and rereeled, so the release coating should be flexible. Filler contents are thus desirably 10–70% by weight of the composition, advantageously 15–60%. In particular where calcium carbonate is the chosen filler a loading of 15 to 60% by weight of the composition has for example been found to be practicable and advantageous.

Optionally the filler particles are coated with a stearate (e.g. zinc, calcium) or other organic compounding aid.

A filler particularly useful is glass microspheres. For example, thick walled hollow microspheres such as those marketed as 'Zeeospheres' (Trade Mark) by Zeelan Industries Inc. and available in the U.K. from Richard Baker Harrison are suitable.

The glass spheres give a desirable initial matt finish in the artificial leather produced. This is particularly necessary where as is often the case the full width of a casting paper is not used every time, so that part of the paper is exposed to the curing heat. In such conditions of use, papers without a filler like glass microspheres quickly develop an undesired gloss in the exposed parts so that a uniform product across the width of the sheet can no longer be made.

When the glass sphere filler is used the manufacture of artificial leather according to the invention may be regarded as use of a method of preventing development of undesired surface gloss in release paper carrying a TPX coating when in repeated use in the manufacture of artificial leather.

Due to its thermal stability and easy release characteristics TPX is used as the polymeric component for release papers to be used with polyvinylchloride, polyurethane and other casts. Sometimes however release is too easy resulting in casts becoming detached over an area before taking up full emboss pattern. The incorporation of a filler unexpectedly "tightens" against premature release but does not impair stripping of the cast after curing, an important advantage of the invention. Moreover the use of filler does not result in deterioration in other desirable properties such as thermal stability of the release layer and the number of times the paper can be reused. It does however allow significant cost reduction since suitable fillers can cost less than 10% of the price of an equal weight of TPX, affording substantial cost savings even allowing for the cost of compounding the filler into the TPX in a separate process.

It is not new to use mineral fillers in TPX compositions generally. Thus for example Japanese Patent Specification 59 174609-A (Mitsui) discloses melt-kneaded compositions of TPX, unsaturated carboxylic acids, and calcium carbonate and other inorganic fillers; Japanese Patent Specification 60 020956 (Teijin) discloses compositions of polycarbonate, acrylic copolymers, TPX and inorganic fillers including talc and calcium carbonate; Japanese Patent Specification 57 119940-A (Matsushita) discloses moulding compositions of TPX in granular form, with calcium carbonate among other minerals However in spite of the obvious economic incentive, neither these nor other Japanese Patent abstracts that we have seen have any suggestion of filled TPX used as the coating in release paper. This may be because many of the compositions set out are in fact unsuitable, since other materials, and in particular other polymers, are present. Essentially, for the severe conditions to which the paper of the present invention will be subjected TPX should constitute the sole polymer present in the release coating.

EXAMPLES

The following examples illustrate the invention.

Examples of fillers successfully incorporated into TPX (grade MX 001) are:

TABLE 1

| Trade Name | Supplier & Description | Mean Particle Size | % Loading used (by weight of composition) |
|---|---|---|---|
| "Omyalite 95T" | (Croxton & Garry) Stearate-coated calcium carbonate | 1 micron (uncoated state) | 25–60 |
| "Omya Durcal 2" | (Croxton & Garry) Uncoated calcium carbonate | 3 microns | 25–60 |
| "Mistron Vapour RP6" | (Cyprus Minerals) Talc | 3 microns | 20–60 |

("Omyalite", "Omya Durcal" and "Mistron" are Trade Marks)

The compounding method was to melt the TPX, feed in the filler, extrude and cut into pellets suited to subsequent use in the extrusion coater. As will be appreciated, the pellets need to be pre-dried before being fed to the coater in view of the high melt temperatures of for example 315°–320° C. in the extruded material. Pre-drying was at 140° C. for 4–6 hours immediately before use.

Coating was done on a conventional pilot mono-extrusion coating line using a heated, Archimedean-screw fed slot extruder under the conditions noted. Both the stearate coated and uncoated calcium carbonate-filled TPX above were successfully extruded to form release coatings on conventional base paper used in the manufacture of film casting papers. Coat weights were somewhat higher than typical values of e.g. 28 g/m$^2$ for TPX alone, for example 40 g/m$^2$ for the 25% calcium carbonate loaded material

USE TRIALS

Tests on the coated materials produced were carried out in order to assess release performance, re-use performance, embossability and thermal stability, with satisfactory results as detailed below. 1. Formation of artificial leather—various polyurethane and polyurethane/polyvinyl chloride artificial leather formulation systems were used and these are shown in the table below. Samples were prepared using a Werner Mathis spreader and were embossed at 100° C.

TABLE 2

| First or skin coat(s) | Bond coat | Doctor Blade Gap (mm) | Drying Temp. °C. (skin coat) | Drying Time |
|---|---|---|---|---|
| Impranil ENB-01 | Tape | 0.15 | 150 | 2 mins |
| Impranil ENB-03 | Tape | 0.15 | 150 | 2 mins |
| Larithane B.12 | Tape | 0.2 | 150 | 90 secs |
| Larithane AL213 | PVC foam | 0.1 | 90 | 90 secs |
| (two coats) | | | + 135 | 60 secs |
| Impranil 43056 | PVC foam | 0.1 | 90 | 90 secs |

TABLE 2-continued

| First or skin coat(s) | Bond coat | Doctor Blade Gap (mm) | Drying Temp. °C. (skin coat) | Drying Time |
|---|---|---|---|---|
| (two coats) | | | + 135 | 60 secs |

('Impranil', 'Larithane' are Trade Marks)

Additionally, an artificial leather was prepared under comparable conditions from polyvinyl chloride alone, the material being 'Vinatex' (Trade Mark) paste from Norsk Hydro Polymers, grade PRC 650307 black 9270.

In the first three of the above systems the tape was used as a laboratory substitute for a bond or support coat and was R1-21 tape from Eurotac (Italy). It was used simply to facilitate the test stripping of the skin coat from the TPX release coating. The polyvinyl chloride was a PVC foam, from Huls Bestolit U 5524, dried 90 seconds at 190° C. Details of the skin coat materials are:

"Impranil" ENB-01 (Bayer) One-component aromatic polyurethane solvated in dimethyl formamide/methyl ethyl ketone.

"Impranil" ENB-03 (Bayer) Internal two-component aromatic polyurethane solvated in a solvent bond containing dimethyl formamide.

"Larithane" B.12 (Larim) Two-component aromatic polyurethane solvated in toluene/dimethylformamide, used with crosslinker and accelerator.

"Larithane" AL213 (Larim) One-component aliphatic polyurethane solvated in dimethylformamide. Two coats, drying at 90° C. for 90 seconds then 135° C. for 60 seconds before the polyvinyl chloride foam is spread on top.

"Impranil" 43056 (Bayer) One-component aromatic polyurethane dispersed in water, dried as last.

2. Release—This is measured by the force required to strip the polyurethane or polyvinyl chloride cast off the coated paper. Testing was carried out using an ICI high speed release tester on strips 20 cm×5 cm cut from the machine direction. The stripping speed was constant at 20 m/min, The results of the release testing are shown in Nm$^{-1}$ (Table 3). Statistical analysis (matched-pair t-testing) shows that a significant tightening of release occurs as filler level increases. Using stearate coated calcium carbonate, a 25% level shows no difference from unfilled TPX but at 40% there is a significant tightening. At 60%, release tightens still further. With uncoated calcium carbonate 25% tightens release significantly but a rise to 40% gives no additional tightening. There is no difference in release between the two calcium carbonates at 40% loading.

TABLE 3

RELEASE VALUES USING UNFILLED/FILLED PLAIN/EMBOSSED TPX COATED PAPER FOR VARIOUS RELEASE SYSTEMS

| SAMPLE | | ENBOI/ TAPE | ENBO3/ TAPE | B12/ TAPE | AL213/ PVC | 43056/ PVC | PVC |
|---|---|---|---|---|---|---|---|
| TPX Standard | PLAIN | 5 | 13 | 18 | 3 | 4 | 19 |
| | EMBOSSED | 5 | 9 | 15 | 4 | 3 | 17 |
| TPX + 25% | PLAIN | 6 | 13 | 18 | 3 | 4 | 21 |
| STEARATE COATED CHALK | EMBOSSED | 4 | 10 | 17 | 4 | 4 | 15 |
| TPX + 40% | PLAIN | 8 | 19 | 21 | 5 | 5 | 24 |
| STEARATE COATED CHALK | EMBOSSED | 6 | 12 | 18 | 8 | 3 | 12 |
| TPX + 60% | PLAIN | 14 | 15 | 26 | 5 | 8 | 19 |
| STEARATE COATED CHALK | EMBOSSED | 9 | 25 | 35 | 4 | 6 | 22 |
| TPX + 25% | PLAIN | 7 | 16 | 22 | 4 | 4 | 23 |
| UNCOATED CHALK | EMOBSSED | 10 | 15 | 23 | 3 | 9 | 21 |
| TPX + 40% | PLAIN | 7 | 21 | 24 | 3 | 9 | 23 |

TABLE 3-continued

| RELEASE VALUES USING UNFILLED/FILLED PLAIN/EMBOSSED TPX COATED PAPER FOR VARIOUS RELEASE SYSTEMS | | | | | | | |
|---|---|---|---|---|---|---|---|
| SAMPLE | | ENBOI/ TAPE | ENBO3/ TAPE | B12/ TAPE | AL213/ PVC | 43056/ PVC | PVC |
| UNCOATED CHALK | EMBOSSED | 7 | 10 | 17 | 6 | 8 | 26 |

3. Re-use—Film casting paper can be used several times by repeating the process after the cast has been stripped off. The re-use values of Table 4 below are the result of release testing on the sixth use of the paper. Statistical analysis of the differences between initial (Table 3) and re-use (Table 4) release values shows that the differences do not vary significantly for different filled or unfilled samples.

In a further re-use test samples of paper coated with filled/unfilled TPX were subjected to 20 passes of PVC (0.45 mm) at 200° C., and design depth and gloss were assessed No significant change in the relative gloss values developed, the filled TPX giving a value of 18% initially (unfilled 16%) rising to 23–24 % (unfilled 22–23%) by the twelfth pass and thereafter being maintained.

TABLE 4

| REUSE VALUES USING UNFILLED/FILLED PLAIN/EMBOSSED TPX COATED PAPER FOR VARIOUS RELEASE SYSTEMS | | | | | | | |
|---|---|---|---|---|---|---|---|
| SAMPLE | | ENBOI/ TAPE | ENBO3/ TAPE | B12/ TAPE | AL213/ PVC | 43056/ PVC | PVC |
| TPX Standard | PLAIN | 5 | 10 | 16 | 3 | 5 | 40 |
| | EMBOSSED | 4 | 8 | 17 | 4 | 3 | 41 |
| TPX + 25% | PLAIN | 5 | 17 | 26 | 4 | 10 | 36 |
| STEARATE COATED CHALK | EMBOSSED | 5 | 10 | 16 | 5 | 5 | 40 |
| TPX + 40% | PLAIN | 9 | 8 | 25 | 4 | 12 | 40 |
| STEARATE COATED CHALK | EMBOSSED | 7 | 14 | 22 | 5 | 4 | 49 |
| TPX + 60% | PLAIN | 13 | 11 | 30 | 7 | 9 | 45 |
| STEARATE COATED CHALK | EMBOSSED | 11 | 17 | — | 6 | 5 | 80 |
| TPX + 25% | PLAIN | 8 | 13 | 30 | 4 | 6 | 53 |
| UNCOATED CHALK | EMOBSSED | 11 | 13 | 18 | 4 | 6 | 54 |
| TPX + 40% | PLAIN | 10 | 13 | 24 | 4 | 8 | 42 |
| UNCOATED CHALK | EMBOSSED | 8 | 15 | — | 5 | 5 | 40 |

4. Embossability—Visual assessment of the embossed paper and casts produced from it show no significant difference in emboss depth and definition between filled and unfilled samples. Filled TPX gave no problems in releasing from the emboss roll, emboss conditions being 100° C.

5. Thermal Stability—Unembossed sheets of unfilled TPX coated paper and filled TPX coated paper (40% stearate-coated calcium carbonate) were heated in an oven for 4 minutes using temperatures increasing at 5o intervals from 200°–230° C. Gloss was measured at each temperature, with a large increase in gloss indicating softening of the polymer and loss of heat resistance. Comparison showed that incorporation of filler does not affect stability, gloss staying at approximately 10% up to 215° C. with very close values for the two samples throughout, then rising rapidly but still in unison.

6. Rheology—Rheological analysis of viscosity against shear rate was carried out at three temperatures, namely 240° C., 250° C. and 280° C. The samples used were two extrusion grades of TPX, namely MX001 and DX820, the latter a lower viscosity grade with higher extrusion rate, and samples of each of these grades filled with 40% stearate coated calcium carbonate. The compounding itself gave no problems whether on a laboratory or trial production scale.

Log viscosity figures over ranges 2.4 to 0.8 and log shear rate figures over ranges 2 to 4 were taken and showed that use of filler had very little effect on these properties. Extrusion conditions are therefore very similar to unfilled TPX. This is an unexpected effect since incorporation of filler would be expected to increase viscosity and adversely affect extrusion conditions.

FURTHER EXAMPLES AND TRIALS

In further trials, carried out generally as before, filled TPX compositions as in Table 5 below were prepared and coated and the resulting release paper used with artificial leather formulation systems giving release values as in Table 6 below. A trial mix of TPX and 68% glass microspheres was also successfully compounded to give an extrudable mix suited to coating.

TABLE 5

| TRADE NAME | SUPPLIER + DESCRIPTION | MEAN PARTICLE SIZE (μm) | % LOADING USED BY WEIGHT OF COMPOSITION |
|---|---|---|---|
| "Zeeospheres 200" | (Richard Baker Harrison) Thick walled, hollow glass microspheres | 4 μm | 25–55 |
| "Polarite 103A" | (ECC International) Silane coated calcined clay | 2 μm | 25 |

('Zeeospheres' and 'Polarite' are Trade Marks)

The coating was at 40g/m$^2$ for the clay loaded composition. For the glass sphere loaded compositions a number of coat weights were used, rising with the proportion incorporated namely 20, 40 and 130 g/m$^2$ respectively for the 25, 40 and 55% loadings.

TABLE 6

REUSE VALUES USING UNFILLED/FILLED PLAIN/EMBOSSED TPX COATED PAPER FOR VARIOUS RELEASE SYSTEMS

| SAMPLE | | ENB-01/ TAPE | ENB-03/ TAPE | AL213/ PVC FOAM | 43056 PVC FOAM | PVC |
|---|---|---|---|---|---|---|
| TPX + 25% | PLAIN | — | — | 11 | 19 | |
| SILANE COATED CLAY | EMBOSSED | — | — | 7 | 11 | — |
| TPX + 25% | PLAIN | 6 | 18 | 6 | 15 | 92 |
| THICK-WALLED, HOLLOW, GLASS MICROSPHERES | EMBOSSED | 13 | 20 | 7 | 11 | 89 |
| TPX + 40% | PLAIN | 31 | 51 | 9 | 22 | 85 |
| MICROSPHERES AS LAST | EMBOSSED | 16 | 22 | 7 | 14 | 89 |
| TPX + 55% MICROSPHERES AS LAST | PLAIN | 37 | 38 | 48 | 51 | — |

We claim:

1. A release paper for the manufacture of artificial leather, comprising a paper having a release coating essentially of a flexible poly (4-methyl pentene-1) resin loaded with particulate mineral filler.

2. Paper of claim 1 wherein the particulate mineral filler is calcium carbonate, kaolin, silica, barytes or talc.

3. Paper of claim 2 wherein the particulate mineral filler particles are coated with stearate or other organic compounding aid.

4. Paper of claim 2 wherein the particulate mineral filler particles are coated with stearate.

5. Paper of claim 1 wherein the particulate mineral filler is in the form of glass microspheres.

6. Paper of claim 1 wherein the particulate mineral filler forms 10–70 % by weight of the release coating composition.

7. Paper of claim 1 wherein the particulate mineral filler forms 15–60% by weight of the release coating composition.

8. A release paper for the manufacture of artificial leather, comprising a paper base having a release coating consisting essentially of a flexible poly (4-methyl pentene-1) resin and particulate mineral filler.

9. A release paper for the manufacture of artificial leather, comprising a paper base having a release coating consisting essentially of a flexible poly (4-methyl pentene-1) resin and a release tightening agent in the form of particulate mineral filler.

* * * * *